United States Patent [19]

Moingeon et al.

[11] Patent Number: 4,629,541

[45] Date of Patent: Dec. 16, 1986

[54] PROCESS FOR THE ELECTROSYNTHESIS OF KETONES

[75] Inventors: Marie-Odile Moingeon, Villabe; Jacques Chaussard, Paris, both of France

[73] Assignee: Societe Nationale des Poudres et Explosifs, Paris, France

[21] Appl. No.: 845,328

[22] Filed: Mar. 28, 1986

[30] Foreign Application Priority Data

Mar. 29, 1985 [FR] France ..... 85 04742

[51] Int. Cl.[4] ..... C25B 1/26; C25B 1/02

[52] U.S. Cl. ..... 204/59 R; 204/72; 204/77

[58] Field of Search ..... 204/59 R, 72, 77

[56] References Cited

U.S. PATENT DOCUMENTS

| | | | |
|---|---|---|---|
| 3,396,093 | 8/1968 | Koehl | 204/59 R |
| 3,764,492 | 10/1973 | Baizer et al. | 204/59 R |
| 3,876,514 | 4/1975 | Baizer | 204/59 R |
| 4,098,657 | 7/1978 | Kay et al. | 204/59 R |
| 4,101,394 | 7/1978 | Johnson | 204/77 |
| 4,410,402 | 10/1983 | Sawyer et al. | 204/59 R |

OTHER PUBLICATIONS

Habeeb et al., J. C. S. Chem. Comm. 1976, pp. 696–697.

Japanese Unexamined Patent Application 52–151122 (English abstract only).

*Primary Examiner*—Arthur P. Demers

*Attorney, Agent, or Firm*—Burns, Doane, Swecker & Mathis

[57] ABSTRACT

The invention relates to a process for the synthesis of ketones by electrochemical reduction of organic halides in the presence of organic acid anhydrides in an electrolysis cell in an organic solvent medium containing a supporting electrolyte. The anode is a metal chosen from the group consisting of magnesium, aluminium, zinc and their alloys. This process has the advantage of being simple and readily capable of being converted to an industrial scale, particularly because of the possibility of employing a cell which has only one compartment. It can be applied to the electrosynthesis of numerous ketones.

15 Claims, No Drawings

PROCESS FOR THE ELECTROSYNTHESIS OF KETONES

The invention relates to a process for the electrosynthesis of ketones by electrochemical reduction of organic halides in the presence of organic acid derivatives, which process is employed in an electrolysis cell in an organic solvent medium containing a supporting electrolyte.

Ketones are compounds which are generally employed in practically all the sectors of the chemical industry, especially as solvents or synthesis intermediates.

In Chemistry Letters, 1977, page 1021–1024, Shono describes the electrosynthesis of benzyl ketones by electrochemical reduction of benzyl chlorides in the presence of carboxylic acid chlorides in an acetonitrile or N,N-dimethylformamide (DMF) medium. The cell necessarily comprises two compartments separated by a ceramic diaphragm, and the anode is made of carbon.

The concentration of the supporting electrolyte is high (in the region of 1M), in a manner which is inherent to the process.

In acetonitrile, the yields of the isolated benzyl ketones vary between 29 and 73%, depending on the products. The use of DMF instead of acetonitrile leads to a considerable drop in this yield in every case.

The electrochemical yields are always very low, taking into account that a quantity of current corresponding to 4 faradays per mole of benzyl chloride are passed through.

The aim of the present invention is, in particular, to simplify such a process and to improve the reaction yields.

The Applicant Company has now found that, unexpectedly, such an aim is attained when an organic acid anhydride is used as the organic acid derivative and a sacrificial anode made of a metal chosen from the group consisting of magnesium, zinc, aluminium and their alloys is used, in combination.

The process according to the invention for the electrosynthesis of ketones by electrochemical reduction of organic halides in the presence of organic acid derivatives in an electrolysis cell fitted with electrodes in an organic solvent medium containing a supporting electrolyte is characterized in that a sacrificial anode is used which is made of a metal chosen from the group consisting of magnesium, aluminium, zinc and their alloys and the organic acid derivatives are organic acid anhydrides.

When compared to the abovementioned process, which constitutes the most closely related state of the art: In this manner, higher mass and electrochemical yields are obtained, for a given solvent, while the process can be applied to the electrosynthesis of numerous ketones and is very considerably simpler to utilize, insofar as it can be carried out in a single-compartment electrolysis cell, without any diaphragm or sinter, which is an important advantage, especially on an industrial scale.

Similarly, the possibility of carrying out the electrolysis at constant current instead of at a controlled potential, also simplifies this utilization.

The concentration of the supporting electrolyte can be much lower.

No deterioration of the solvent is observed at the anode, as is the case when an inert anode is used.

These advantages are especially worthy of consideration.

According to a particular embodiment of the invention, the organic halides respond to the general formula $R_1X$ in which X denotes a halogen chosen from the group consisting of chlorine, bromine and iodine, and $R_1$ denotes:

a substituted or unsubstituted, saturated or unsaturated, aliphatic or alicyclic chain.

$R_1$ preferably denotes an aliphatic chain substituted by at least one aromatic group such as, for example in benzyl chloride, benzyl bromide, 1-phenyl-1-chloroethane and 1-phenyl-1-chloropropane.

In general $R_1$ may bear groups which are not capable of being electroreduced or which are more difficult to reduce than the $R_1$-X bond, under the experimental conditions of the electrosynthesis. Such groups which are incapable of being electroreduced are, for example, the cyano, ether, sulphide or ester groups.

According to another particular embodiment of the invention, the organic acid anhydrides correspond to the general formula

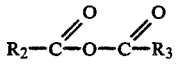

in which $R_2$ denotes:

a substituted or unsubstituted, saturated or unsaturated, aliphatic or alicyclic chain, a substituted or unsubstituted aryl group, a substituted or unsubstituted aromatic heterocyclic ring, such as, for example, the furan, thiophene or pyridine ring, and $R_3$ denotes:

a substituted or unsubstituted, saturated or unsaturated, aliphatic or alicyclic ring, a substituted or unsubstituted aryl group, a substituted or unsubstituted aromatic heterocyclic ring, such as, for example, the furan, thiophene or pyridine ring, a group $OR_4$, in which $R_4$ denotes:

a substituted or unsubstituted, saturated or unsaturated, aliphatic or alicyclic chain, a substituted or unsubstituted aryl group, a substituted or unsubstituted aromatic heterocyclic ring, such as, for example, the furan, thiophene or pyridine ring, or, alternatively, $R_2$ and $R_3$ form at least one substituted or unsubstituted ring, as in the case, for example, of phthalic anhydride or succinic anhydride.

When $R_3$ denotes a group $OR_4$, the corresponding anhydrides are then mixed anhydrides of carboxylic acids and carbonic acid. In all other cases they are anhydrides of carboxylic acids.

Ketones corresponding to the general formula:

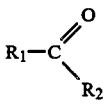

are obtained when the organic halides correspond to the general formula $R_1X$.

In general, $R_2$ and $R_3$ may carry functional groups which are not capable of being electroreduced, or which are more difficult to reduce than the $R_1$-X bond under the experimental conditions of the electrosynthesis, and none of the groups carried by $R_1$ or $R_2$ should be more electrophilic than the anhydride group itself.

In a preferred manner, $R_2$ and $R_3$ denote a linear or branched alkyl chain.

Also in a preferred manner, $R_2$ and $R_3$ are identical.

In an especially preferred manner, $R_2$ and $R_3$ are identical and denote a straight or branched alkyl chain, as in the case, for example, of acetic anhydride.

The electrosynthesis may be carried out in the presence of a catalyst, an organometallic complex of a transition metal such as nickel or palladium. This complex may be bi- or polymetallic. The complex $NiBr_2$(Bipyridine) is preferably used.

When the halide is difficult to reduce or when the anhydride is easily reducible, it is found that the use of such a complex improves the yield very appreciably.

According to the process which is the subject of the present invention, an anode is used which is made of a metal chosen from the group consisting of magnesium, aluminium, zinc and their alloys. "Their alloys" means any alloy containing at least one of the three abovementioned metals, namely magnesium, aluminium and zinc. This anode may be of any shape and, in particular, may be of any of the conventional shapes of metal electrodes which are well known to the man skilled in the art (twisted wires flat bar, cylindrical bar, renewable bed, balls, cloth, grid, and the like).

Preferably, a cylindrical bar is used, whose diameter is adapted to the dimensions of the cell. For example, for a cell whose total capacity is between approximately 50 $cm^3$ and approximately 500 $cm^3$, the bar diameter is of the order of 1 cm.

Before use, the surface of the anode is preferably cleaned chemically (using dilute HCl, for example), or mechanically (using a file or emery cloth, for example) in order, in particular, to remove the metal oxide which is often present on the surface of the metal.

The cathode is made of any metal such as stainless steel, nickel, platinum, gold, silver, or of carbon. It preferably consists of a grid or a cylindrical plate arranged concentrically around the anode.

The electrodes are supplied with direct current by means of a stabilized supply.

The organic solvents used within the scope of the present invention are any weakly protic solvents which are usually employed in organic electrochemistry. Examples which may be mentioned are DMF, acetonitrile, tetramethylurea (TMU), tetrahydrofuran (THF) and mixtures of tetrahydrofuran with hexamethylphosphorotriamide. DMF is preferably used.

The suppoztIng electrolytes which are used may be those usually employed in organic electrochemistry. There may be mentioned, for example, the salts in which the anion is a halide, a carboxylate, an alcoholate, a perchlorate or a fluoroborate, and the cation a quaternary ammonium, lithium, sodium, potassium, magnesium, zinc or aluminium.

Among these salts, special mention may be made of tetraalkylammonium tetrafluoroborates (tetrabutylammonium tetrafluoroborate, for example) tetrabutylammonium perchlorate, tetraalkylammonium halides (for example tetrabutylammonium chloride or tetrabutylammonium iodide) and lithium perchlorate.

The concentration of the supporting electrolyte in the organic solvent is preferably between 0.01 M and 0.5 M.

Also preferably, the concentration of organic halides in the organic solvent is between 0.2 M and 2 M.

The ratio of the concentration of the organic acid anhydride to the concentration of the organic halide in the organic solvent may have any value. An excess of anhydride and, in particular, a concentration ratio of between 1 and 20 will preferably be used.

The electrolysis is carried out:

(1) in a conventional electrolysis cell, well known to the man skilled in the art, comprising only a single compartment, (2) at a temperature which is generally between −20° C. and +80° C. preferably between −10° C. and +40° C., advantageously in the region of 0° C., (3) at a cathode current density which preferably varies between 0.1 and 10 $A/dm^2$. In general, and preferably, the operation is carried out at a constant current, but it is also possible to operate at a constant voltage, at a controlled potential or with variable current and potential, (4) while the solution is being stirred, for example by means of a bar magnet, after the solution has been degassed by bubbling an inert gas, for example nitrogen or argon.

After the passage of a quantity of current corresponding to approximately 2 faradays ($2\times96{,}500$ C) per mole of organic halides or, if appropriate, until the latter have been completely converted, the electrolysis is discontinued.

The principle constituents of the mixture, namely the unreacted organic halide, the required products, and certain reaction byproducts, are then determined in an aliquot portion of the solution, using gas chromatography (GC), in a manner known to the man skilled in the art. The required products are then extracted, isolated and purified in a conventional manner.

The reaction solvent and the volatile compounds may, for example, be evaporated off under vacuum, and then the remaining residue may be hydrolysed, for example with dilute hydrochloric acid.

The ketones are extracted, for example with ether. After evaporation of the extraction solvent a crude product is isolated, which is identified from its IR and NMR spectra and whose purity or composition is determined by (GC). The product or products are purified, if appropriate, for example by distillation.

The pure ketone isolated in this manner (its purity verified using (GC) is identified from its IR and NMR spectra.

The invention is illustrated by the following examples, which are not limiting in nature. To produce these examples, a conventional electrolysis cell was used, with a total capacity of approximately 250 $cm^3$, comprising only a single compartment and equipped with pipes permitting the entry and the exit of the inert gas, sampling of the solution, if appropriate, during the electrolysis, and the passage of electricity.

The anode consists of a cylindrical bar, 1 cm in diameter. It is introduced into the cell through a central tube and is thus situated in an approximately axial position relative to the cell.

The cathode consists of a cylindrical metal felt arranged concentrically around the anode. The working surface of the cathode is of the order of 1 $dm^2$. The cell is immersed in a thermostat bath controlled at the selected temperature.

The specific operating conditions (nature of the electrodes, of the supporting electrolyte, of the solvent employed, the reaction temperature, and the like) are shown in detail, furthermore, for each example.

EXAMPLES 1 to 7

Synthesis of benzyl methyl ketone (phenylacetone) from benzyl chloride and acetic anhydride.

In these examples, the anode is made of magnesium or aluminium, the cathode of nickel the solvent is DMF (110 g) and the supporting electrolyte is tetrabutylammonium fluoroborate (2 g, i.e. 6 mmol).

After the electrolysis (2.2 faradays per mole of benzyl chloride), the remaining benzyl chloride, the toluene which is a byproduct of the reduction of benzyl chloride, and benzyl methyl ketone, both in free form and in the form of its enol acetate, are determined by GC in an aliquot portion.

After the DMF has been evaporated off and the residue has been hydrolysed with hot dilute HCl, benzyl methyl ketone is isolated by extraction with ether. Pure benzyl methyl ketone has been identified from its IR and NMR spectra, and its purity has been verified by GC.

The specific operating conditions of the electrolysis in each Example, and the results obtained, are collated in Table I.

EXAMPLE 8

Synthesis of 4-tert-butylphenylacetone, of formula

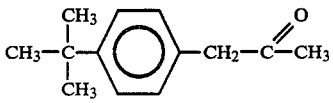

from 4-tert-butylphenylchloromethane and acetic anhydride.

The specific conditions in this example are the same as those in Example 4, but benzyl chloride is replaced by 4-tert-butylphenylchloromethane of formula

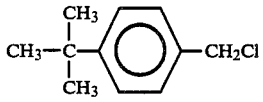

After electrolysis (2.2 faradays per mole of organic halide), the solvent is evaporated off and then the residue obtained is hydrolyzed with hot dilute HCl. 4-tert-Butylphenylacetone is then isolated by ether extraction, followed by vacuum distillation. The pure 4-tert-butylphenylacetone isolated in this manner (73% yield) was identified from its IR and NMR spectra and its purity was verified by GC.

EXAMPLE 9

Synthesis of 3,4-dimethoxyphenylacetone of formula

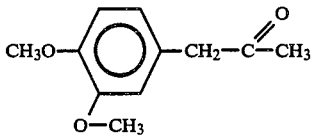

from 3,4-dimethoxyphenylchloromethane and acetic anhydride.

The specific conditions in this example are the same as those in Example 4, but benzyl chloride is replaced by 3,4-dimethoxyphenylchloromethane of formula

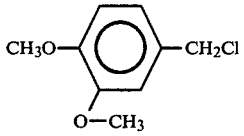

After electrolysis (2.2 faradays per mole of organic halide), the solvent is evaporated off and then the residue obtained is hydrolysed with hot dilute HCl. 3,4-Dimethoxyphenylacetone is then isolated by ether extraction followed by vacuum distillation.

The pure 3,4-dimethoxyphenylacetone isolated in this manner (25% yield) was identified from its IR and NMR spectra and its purity was verified by GC.

EXAMPLES 10 to 20

Using the same method as in Example 1, the various ketones are prepared from the halides and anhydrides shown in Table II. The results and operating conditions of these tests are also collated in this table.

A mixture of ketones is obtained in Examples 15 and 19.

In Examples 16 and 20, a mixture of ketone and ester is obtained, the ketone being produced preferentially (example 16:95% of ketone, 5% of ester; Example 20:75% of ketone and 25% of ester).

EXAMPLE 21

Synthesis of 4-oxo-6-methyl-6-heptenoic acid of formula

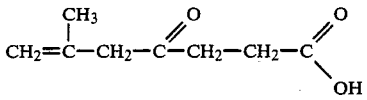

from 35 mmol of 3-chloro-2-methyl-1-propene (methallyl chloride) and 35 mmol of succinic anhydride.

The solvent is DMF (30 $cm^3$), the anode is made of zinc and the cathode of stainless steel. The reaction temperature is 20° C. The supporting electrolyte is tetrabutylammonium iodide (2 $10^{-2}$ M).

The solution also contains 1.5 mmol of a catalyst, an organometallic complex of a transition metal, namely the complex $NiBr_2$—2,2'-bipyridyl, also known as $NiBr_2$ (Bipyridine) or $NiBr_2$Bipy. To prepare this catalyst, 2 $10^{-2}$ mole of $NiBr_2$ and 2 $10^{-2}$ mole of 2,2'-bipyridine are added together in 120 $cm^3$ of absolute ethanol. The solution is stirred for 24 hours at 20° C. $NiBr_2$Bipy precipitates out (light green precipitate). This precipitate is separated off by filtration and then washed with acetone (20 to 25 $cm^3$) and it is then dried in vacuum at 20° C. 1.8 $10^{-2}$ mol of $NiBr_2$Bipy (90% yield) is recovered. The electrolysis is carried out at a cathode current density of 2A/$dm^2$. After the passage of a quantity of current corresponding to 3 faradays per mole of halide the electrolysis is discontinued. The DMF is then evaporated off under vacuum and the residue is then hydrolysed with dilute hydrochloric acid. The required product is then extracted with ether and the ether phase is washed with an aqueous solution of sodium hydroxide. The aqueous phase is then acidified (hydrochloric acid) and reextracted with ether.

After the ether has been evaporated off, 4-oxo-6-methyl-6-heptenoic acid, identified from its IR and NMR spectra, is isolated in a 30% yield based on the starting halide.

The ketones obtained by this process are especially useful as starting materials for the manufacture of drugs or perfumery products or useful in the plant-protection field. Thus, for example, phenylacetone is used in the manufacture of amphetamines, trifluoromethylphenylacetone, phenoxyphenylbutanone and dimethoxyphenylacetone are used, respectively, in the manufacture of fenfluramine, fenoprofen and methyldopa. In perfumery and in the plantprotection field, tert-butylphenylacetone is used to manufacture lilial.

TABLE I

| Example No. | $C_6H_5CH_2Cl$ (mmol) | Acetic anhydride (mmol) | Electrolysis current (A) | Reaction temperature (°C.) | Degree of conversion of $C_6H_5CH_2Cl$ (%) | Mass yields (%) | Electrochemical yield (%) |
|---|---|---|---|---|---|---|---|
| 1 | 79 | 686 | 1 | 0 | 64 | 54[a,c]<br>84[b] | 49 |
| 2 | 79 | 196 | 2 | 0 | 55 | 38[a,d]<br>70[b] | 35 |
| 3 | 79 | 686 | 2 | 25 | — | 39[e] | — |
| 4 | 79 | 686 | 2 | 2 | — | 59[a,f] | — |
| 5 | 30 | 120 | 2 to 4 | −10 | — | 50 | 25 |
| 6 | 30 | 120 | 2 to 4 | −10 | — | 50 | 25 |
| 7 | 30 | 120 | 2 to 4 | −10 | — | 80 | 40 |

[a]As benzyl methyl ketone formed, based on initial benzyl chloride
[b]As benzyl methyl ketone formed, based on benzyl chloride converted
[c]including 20 in the form of enol acetate
[d]including 14 in the form of enol acetate
[e]as pure benzyl methyl ketone isolated, based on initial benzyl chloride
[f]including 22 in the form of enol acetate

TABLE II

| Example No. | Alkyl halide (mmol) | Acid anhydride (mmol) | Electrolysis current (A) | Reaction temperature (°C.) | Anode | Mass yield of ketone (%) | Electrochemical yield (%) |
|---|---|---|---|---|---|---|---|
| 10 | $C_6H_5CH_2Cl$<br>(30) | $(CH_3CO)_2O$<br>(120) | 2 to 4 | −10 | Al | 50 | 25 |
| 11 | $CH_2{=}CH(CH_3){-}CH_2Cl$<br>(30) | $(CH_3CO)_2O$<br>(120) | 2 to 4 | −5 | Mg | 75 | 37 |
| 12 | $C_6H_5{-}CH(CH_3)Cl$<br>(71) | $(CH_3CO)_2O$<br>(650) | 2 | 2 | Mg | 70 | 51 |
| 13 | 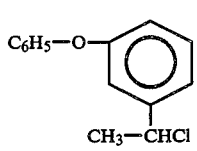 <br>(143) | $(CH_3CO)_2O$<br>(784) | 2 | 2 | Mg | 94 | 47 |
| 14 | 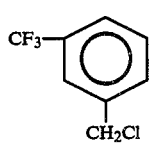 <br>(52) | $(CH_3CO)_2O$<br>(650) | 2 | 2 | Mg | 58 | 45 |
| 15 | $C_6H_5CH_2Cl$<br>(87) | $(tBu){-}C(=O){-}O{-}C(=O){-}CH_3$<br>(400) | 2 | 2 | Mg | 35 | 22[1] |
| 16 | $C_6H_5CH_2Cl$<br>(47) | $CH_3{-}C(=O){-}O{-}C(=O){-}OEt$<br>(91) | 2 | 2 | Mg | 40 | 34[2] |
| 17 | $C_6H_5CHCl_2$<br>(30) | $(CH_3CO)_2O$<br>(120) | 2 | −5 | Mg | 15 | 7 |
| 18 | $C_6H_5CHCl_2$ | $(CH_3CO)_2O$ | 2 | −5 | Al | 17 | 9 |

TABLE II-continued

| Example No. | Alkyl halide (mmol) | Acid anhydride (mmol) | Electrolysis current (A) | Reaction temperature (°C.) | Anode | Mass yield of ketone (%) | Electrochemical yield (%) |
|---|---|---|---|---|---|---|---|
| | (130) | (120) | | | | | |
| 19 | $C_6H_5CH_2Cl$ (110) | $iPr-\overset{O}{\overset{\|}{C}}-O\overset{O}{\overset{\|}{C}}CH_3$ (120) | 2 | 2 | Mg | — | —(3) |
| 20 | $C_6H_5CH_2Cl$ (79) | $(tBu)-\overset{O}{\overset{\|}{C}}-O-\overset{O}{\overset{\|}{C}}-OEt$ (23) | 2 | 2 | Mg | — | —(1) |

(1)The acid anhydride is prepared in situ by reacting sodium acetate with pivaloyl chloride
(2)The acid anhydride is prepared by reacting acetic acid with ethyl chloroformate in the presence of triethylamine in ethyl ether
(3)The acid anhydride is prepared in situ by reacting sodium acetate with isobutyl chloride

We claim:

1. Process for the electrosynthesis of ketones comprising electrochemically reducing organic halides in the presence of organic acid derivatives in an electrolysis cell fitted with electrodes in an organic solvent medium containing a supporting electrolyte, wherein a sacrificial anode comprising a metal chosen from the group consisting of magnesium, aluminium, zinc and their alloys is used, and wherein said organic acid derivatives are organic acid anhydrides.

2. Process according to claim 1, wherein said organic halides correspond to the general formula of $R_1X$ in which X denotes a halogen and $R_1$ denotes a substituted or unsubstituted, saturated or unsaturated, aliphatic or alicyclic chain.

3. Process according to claim 2, wherein $R_1$ denotes an aliphatic chain substituted by at least one aromatic group.

4. Process according to claim 1, wherein said organic acid anhydrides correspond to the general formula $$R_2-\overset{O}{\overset{\|}{C}}-O-\overset{O}{\overset{\|}{C}}-R_3,$$

in which $R_2$ denotes:

a substituted or unsubstituted, saturated or unsaturated aliphatic or alicyclic chain;

a substituted or unsubstituted aryl group; or a substituted or unsubstituted aromatic heterocycloc ring; and $R_3$ denotes:

a substituted or unsubstituted, saturated or unsaturated, aliphatic or alicyclic chain;

a substituted or unsubstituted aryl group;

a substituted or unsubstituted aromatic heterocyclic ring;

a group $-OR_4$ in which $R_4$ denotes:

a substituted or unsubstituted, saturated or unsaturated aliphatic or alicyclic chain;

a substituted or unsubstituted aromatic heterocyclic ring; or, $R_2$ and $R_3$ form at least one substituted or unsubstituted ring.

5. Process according to claim 4, wherein $R_2$ and $R_3$ are identical.

6. Process according to claim 4 wherein $R_2$ and $R_3$ denote an alkyl chain.

7. Process according to claim 1, wherein said organic solvent medium is N,N-dimethylformamide.

8. Process according to claim 1, wherein said organic halides are present in a concentration of between 0.2 M and 2 M.

9. Process according to claim 1, wherein the ratio of the concentration of said organic acid anhydride to the concentration of said organic halide in said organic solvent medium is between 1 and 20.

10. Process according to claim 1, wherein the temperature of electrolysis is between −20° C. and +80° C.

11. Process according to claim 1, wherein the cathode current density is between 0.1 $A/dm^2$ and $A/dm^2$.

12. Process according to claim 1, wherein said electrolysis is carried out at constant current.

13. Process according to claim 1, wherein the concentration of said supporting electrolyte is between 0.01 M and 0.5 M.

14. Process according to claim 1, wherein said electrolysis is carried out in the presence of an organic complex of a transition metal.

15. Process according to claim 14, wherein said complex is $NiBr_2$-(Bipyridine).

* * * * *